United States Patent [19]

Hutcheon

[11] 4,438,704

[45] Mar. 27, 1984

[54] CASSETTE FOR CURRENCY NOTES OR OTHER VALUABLE ARTICLES

[75] Inventor: Alfred J. Hutcheon, Dundee, Scotland

[73] Assignee: NCR Corporation, Dayton, Ohio

[21] Appl. No.: 207,496

[22] Filed: Nov. 14, 1980

[30] Foreign Application Priority Data

Jul. 14, 1980 [GB] United Kingdom ..... 8022942

[51] Int. Cl.[3] ..... G08B 13/06

[52] U.S. Cl. ..... 109/44; 109/70; 221/4; 194/1 B

[58] Field of Search ..... 109/38, 43, 44, 45, 109/47, 49, 52, 57, 70; 221/197, 198, 4; 312/215, 219; 194/1 B; 232/15; 271/117, 121

[56] References Cited

U.S. PATENT DOCUMENTS 4,186,977 2/1980 Gilovich et al. ..... 109/52

4,275,667 6/1981 Hilton ..... 109/44

FOREIGN PATENT DOCUMENTS 4436 3/1979 European Pat. Off. .

*Primary Examiner*—Robert Peshock

*Assistant Examiner*—John Weiss

*Attorney, Agent, or Firm*—J. T. Cavender; Albert L. Sessler, Jr.; Elmer Wargo

[57] ABSTRACT

A cassette which is arranged to hold currency notes or other valuable articles and which may be used for transporting currency notes from a bank to an automatic cash dispensing machine. The cassette includes a receptacle for notes, and locking mechanism for locking and unlocking the receptacle. There is provided a tampering indicating mechanism which is arranged to be actuated during an unlocking and locking cycle of operation of the locking mechanism, this indicating mechanism including a latch which is set to a first state when the cassette is loaded with notes. The latch is tripped during an unlocking operation of the locking mechanism, the latch when tripped serving to prevent any further unlocking operation until such time as the latch is reset to its first state.

8 Claims, 7 Drawing Figures

CASSETTE FOR CURRENCY NOTES OR OTHER VALUABLE ARTICLES

BACKGROUND OF THE INVENTION

This invention relates to an apparatus for storing currency notes or other valuable articles, and which apparatus (hereinafter called cassette) may be used for transporting currency notes or other valuables from a bank to an automatic cash dispensing machine.

This invention has application, for example, to an automatic cash dispensing machine or financial terminal of the kind wherein a user inserts a customer identifying card into the machine and then enters certain data (such as codes, quantity of currency required or to be paid in, type of transaction, etc.) upon a keyboard associated with the machine. The machine will then process the transaction, update the user's account to reflect the current transaction, dispense cash if necessary, and return the card to the user as part of a routine operation. A cassette in accordance with the invention may be used to transport currency notes from a bank to a location, remote from the bank, at which location a cash dispensing machine or financial terminal is situated.

Both secure and non-secure cassettes are known for use with cash dispensing machines or financial terminals. Non-secure cassettes are not lockable, and the contents of such cassettes are readily accessible during transport. In contrast, in known secure cassettes, the contents of such cassettes are not readily accessible to an unauthorized person during transport; however, these cassettes are relatively complex, and may require a power input for the purpose of operating a currency access enabling and disabling mechanism.

SUMMARY OF THE INVENTION

According to this invention, there is provided a cassette for currency notes or other valuable articles, for example, including a receptacle for storing the notes or articles, and locking means for locking the receptacle in a closed condition and for unlocking the receptacle so as to permit access to the contents thereof, the cassette including a tamper indicating means (or means for indicating tampering) which is arranged to be actuated during an unlocking and locking cycle of operation of the locking means so as to give an indication that such cycle has in fact taken place.

Compared with known non-secure cassettes, a cassette made in accordance with the present invention has the advantage in that the tamper indicating means of the cassette makes it feasible for the transportation of the cassettes from a bank to cash dispensing machines or financial terminals to be entrusted to third parties such as security firms.

It is an object of the invention to provide a cassette for currency notes which is of simple construction, require no power input, and which has the advantages of the secure cassettes.

This invention will be more readily understood in connection with the following description, claims, and drawing.

DETAILED DESCRIPTION OF THE INVENTION

Figure 1:
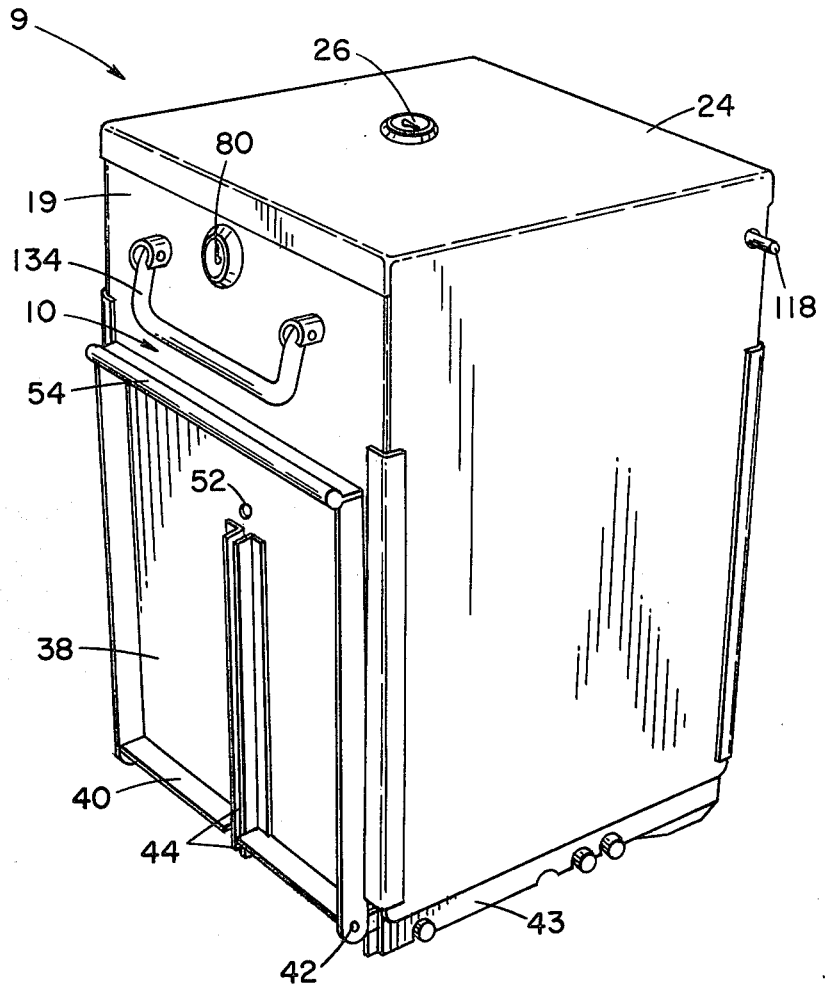
FIG. 1 is a perspective view of a cassette for currency notes with a cover shown locked in position and with a base slide assembly shown in a retracted position.

The cassette shown in the drawings is adapted to be inserted into a compartment formed in the rear of an automatic cash dispensing machine (not shown) of the kind previously referred to. The cash dispensing machine is arranged to extract currency notes from the cassette when the cassette is in an unlocked condition, for dispensing to a customer. Before dispensing the notes, the machine checks that the notes meet certain criteria, and also transfers any notes rejected by the machine back into the cassette.

Figure 2:
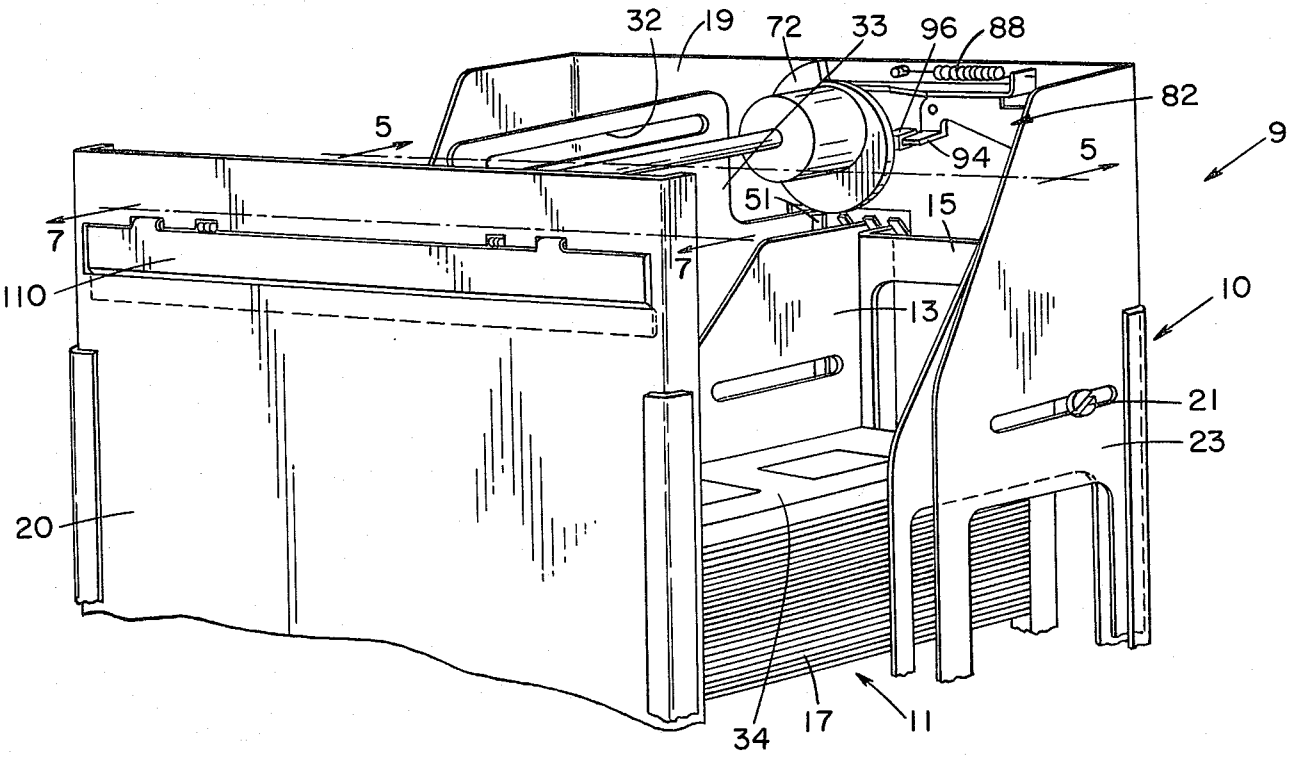
FIG. 2 is a perspective view of the upper part of the cassette with the cover removed, showing a stack of currency notes in position in a receptacle in the cassette.

Referring now to the drawings, the cassette 9 (FIG. 1) includes a housing 10 which is divided into two separate compartments 11 and 12 (FIG. 4) by means of two pairs of side plates 13 and 14 and by means of two end plates 15 and 16 (FIG. 4), each compartment being designed to hold a stack of currency notes 17 (FIG. 2). The side plates 13 and 14 slidably engage notches 18 (FIG. 4) provided in front and rear walls 19 and 20 of the housing 10, so that the spacing apart of each pair of side plates 13 and 14 may be adjusted to receive the widths of the notes 17 therebetween. Also, the spacing of the end plates 15 and 16 from the rear wall 20 may be adjusted by means of fasteners 21 (FIG. 4) which coact with horizontally extending slots 22 (FIG. 3) formed in side walls 23 of the housing 10. Thus, the size of each compartment 11 or 12 can be adjusted to accommodate currency notes of a particular denomination; as shown in FIG. 4, the two compartments 11 and 12 may be adjusted to be of different sizes, so that, if desired, the cassette 9 can hold currency notes of two different denominations or sizes.

Figure 3:
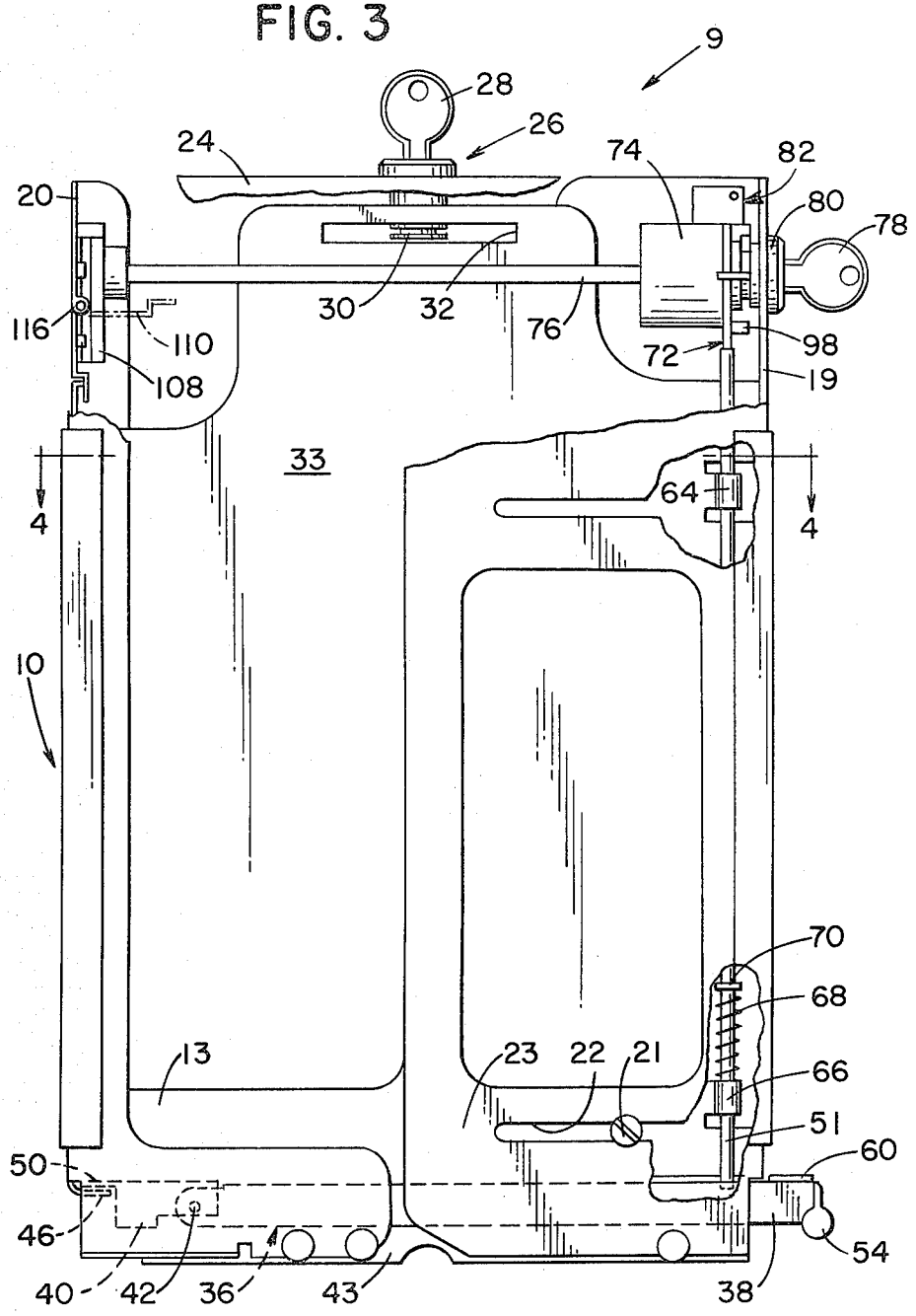
FIG. 3 is a side-elevational view of the cassette when empty, with the cover thereof shown largely broken away and with the base slide assembly in a fully-inserted position.
Figure 4:
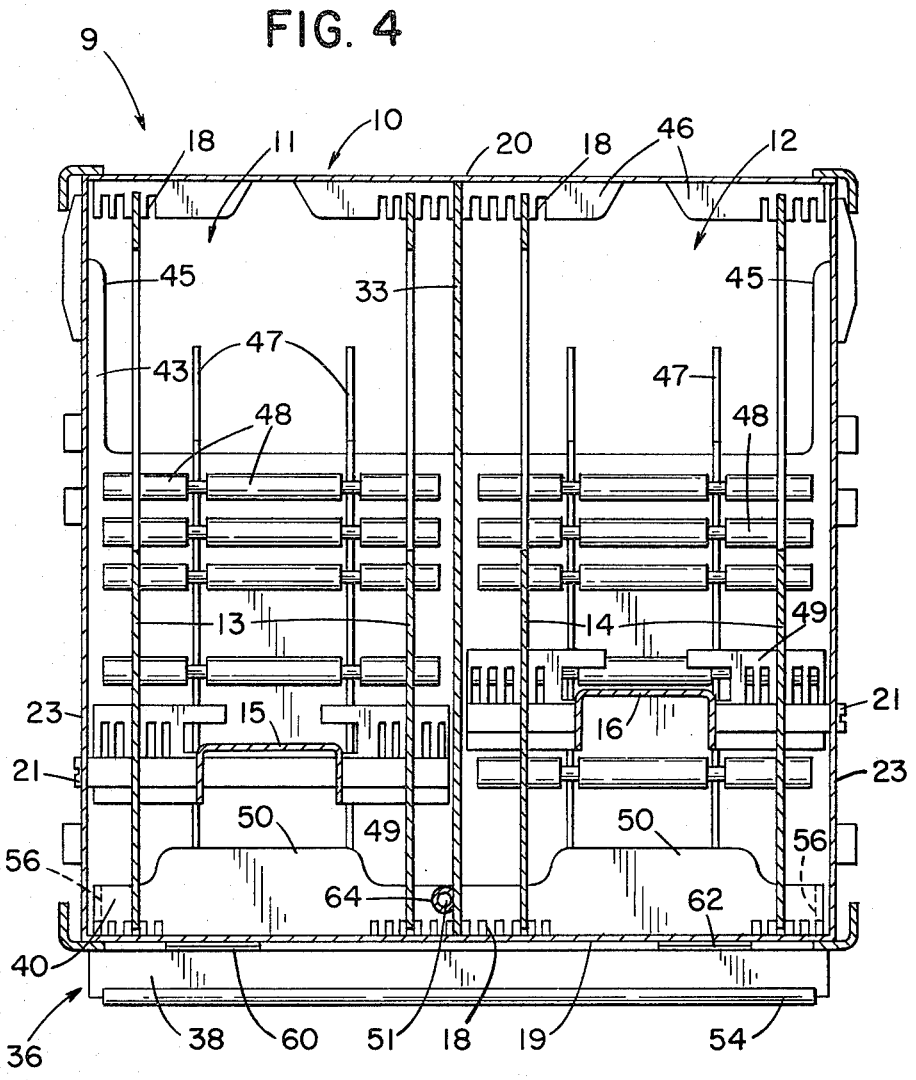
FIG. 4 is a part-sectional, plan view taken along the line 4—4 of FIG. 3 but with the base slide assembly shown in a retracted position.

The housing 10 is provided with a cover 24 (FIG. 1) which can be locked in a position covering the housing 10 by means of a locking mechanism 26 operated by a key 28 (FIG. 3). It should be understood that the housing 10 and the cover 24 together form a receptacle for the currency notes 17, which receptacle can be locked in a closed condition so as to prevent access to the notes as will be made clear later herein.

The locking mechanism 26 is provided with a lever 30 (FIG. 3) which, by operation of the key 28, is arranged to be rotated into engagement with a slot 32 formed in a central plate 33 extending between the front and rear walls 19 and 20, so as to lock the cover 24 firmly in position on the housing 10. With the cover 24 removed, the notes 17 can be stacked in the compartments 11 and 12, the notes in each stack being retained in position by means of an associated weight or packer plate 34 (FIG. 2) which bears down freely on the top note in the stack.

The lower part of the housing 10 is provided with a base slide assembly 36 (FIG. 3) which comprises a main slide 38 and an end slide 40, the two slides 38 and 40 being pivotally connected together by means of studs 42. The slide assembly 36 is slidably mounted on, and positioned above, a base member 43 of the housing 10, and grooved members 44 (FIG. 1) are provided on the under surfaces of the slides 38 and 40 to engage a guide rail (not shown) provided on the upper surface of the base member 43. The base member 43 has formed therein an opening 45 (FIG. 4) whose purpose will be described later herein. The slide assembly 36 is arranged to be movable between a fully inserted or closed position, as shown in FIG. 3, in which it closes the opening 45 in the base member 43, and a fully retracted or open position in which the main slide 38 is pivoted upwardly into a vertically extending position as shown in FIGS. 1 and 4.

When the slide assembly 36 is in its fully retracted position shown in FIG. 4, currency notes 17 contained in the compartments 11 and 12 are supported by inwardly projecting lips 46 provided at the lower edge of the rear wall 20 of the housing 10, by arms 47 and rollers 48 mounted on the base member 43, and by resilient support members 49 secured to the lower edges of the plates 15 and 16.

When the slide assembly 36 is pushed from its fully retracted position shown in FIG. 4 into its fully inserted position shown in FIG. 3, the assembly 36 passes beneath the support members 49 and over the arms 47 and rollers 48; with the assembly 36 in its fully inserted position, end portions 50 of the slide 40 are disposed immediately above the lips 46 (FIG. 3) and the support members 49 bear down resiliently on the slide 38.

The slide assembly 36 (FIG. 3) is arranged to be locked in its fully-inserted position by means of a vertically-extending, locking member or shaft 51 which engages a circular aperture 52 (FIG. 1) in the slide 38. When the locking shaft 51 is moved upwardly (as viewed in FIG. 3) out of engagement with the aperture 52 in a manner to be described hereinafter, the slide assembly 36 may be moved from left to right (as viewed in FIG. 3) by means of a handle 54 provided on the slide 38 until lugs 56 (FIG. 4), provided on the slide 38, abut against stop means (not shown) provided on the base member 43 of the housing 10. As mentioned above, with the slide assembly 36 in a fully retracted position, the slide 38 may be pivoted upwardly into a vertical position, the slide 38 being held in this position by means of conventional adhesive pile strips 60 (FIGS. 3 and 4) provided on the slide 38 engaging complementary adhesive strips 62 (FIG. 4) provided on the outside of the front wall 19 of the housing 10. After the slide assembly 36 has been fully retracted from the cassette 10 as shown in FIG. 4, currency notes 17 can be withdrawn from the compartments 11 and 12 via the opening 45 in the base member 43. The cash dispensing machine in which the cassette 9 may be installed has a currency dispensing apparatus (not shown but associated therewith) which coacts with the notes 17 to pick or withdraw them through the opening 45.

The locking shaft 51 (FIG. 3) is slidably mounted in bushings 64 and 66 secured to the central plate 33. The shaft 51 is urged or biased away from the base member 43 by means of a compression spring 68, one end of which bears against a collar 70 secured to the shaft 51 and the other end of which bears against the lower bushing 66.

Figure 5:
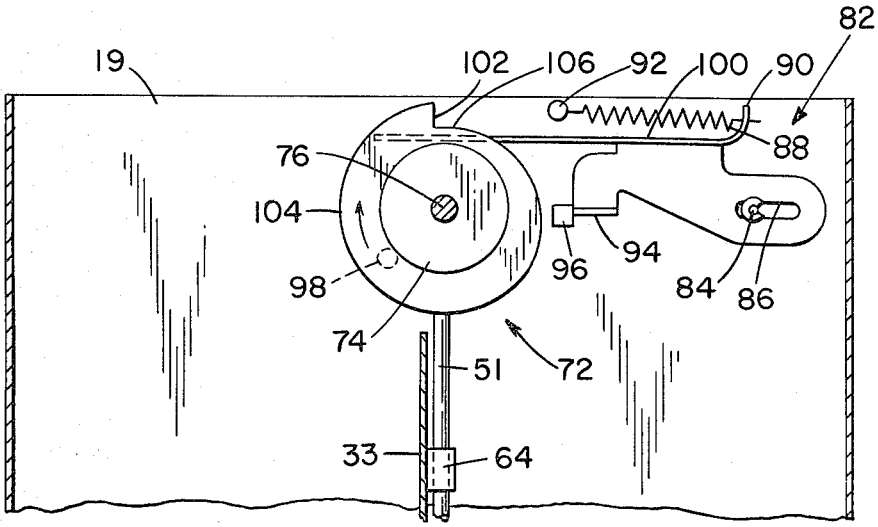
FIG. 5 is a part-sectional view taken along the line 5—5 of FIG. 2, showing the tamper indicating mechanism of the cassette in a first state.
Figure 6:
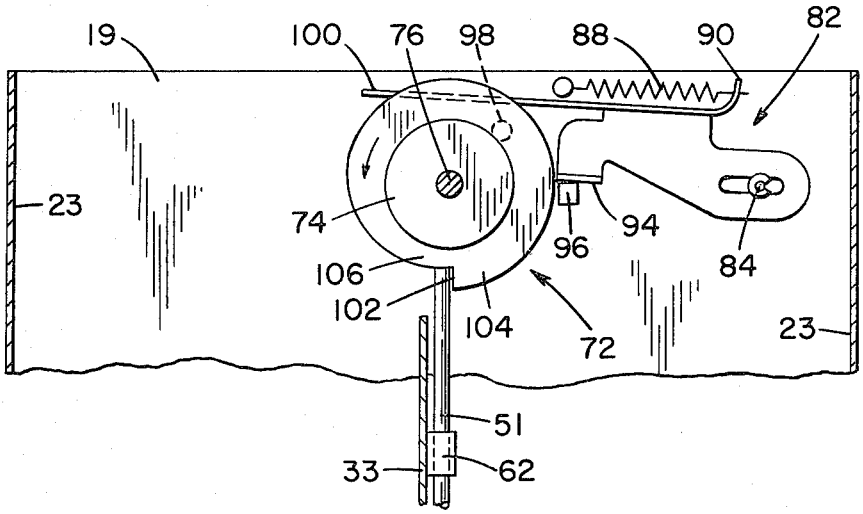
FIG. 6 is a view similar to FIG. 5, showing the tamper indicating mechanism in a second state.

Referring now particularly to FIGS. 3, 5, and 6, the upper end of the locking shaft 51 bears against the periphery of a cam 72 secured to a hub 74 mounted on a horizontally extending key shaft 76, the ends of the key shaft 76 being rotatably mounted in the front and rear walls 19 and 20 of the housing 10. The shaft 76 is arranged to be rotated by means of a key 78 associated with a locking mechanism 80 mounted on the front wall 19.

The cam 72 and hub 74 (FIGS. 3, 5, and 6) are associated with a latch generally designated 82. The latch 82 is slidably and pivotably mounted on a stud 84 secured to the front wall 19; the stud 84 engages a slot 86 formed in the latch 82. The latch 82 is urged from right to left with reference to FIGS. 5 and 6 by a tension spring 88, one end of which is connected to a projection 90 on the latch 82 and the other end of which is connected to a stud 92 secured to the housing 10. With the cover 24 removed from the housing 10, the latch 82 can be manually primed or activated by moving it against the tension of the spring 88 so as to bring a lug 94 formed on the latch 82 into engagement with a stop member 96 secured to the housing 10, as shown in FIG. 5. A stud 98 is provided on that side of the cam 72 facing the front wall 19 of the housing 10, the stud 98 being arranged to engage an extension 100 of the latch 82 during a rotation of the cam 72 as will be described hereinafter. Also, the cam 72 is provided with a shoulder 102 where a high portion 104 of the cam 72 meets a low portion 106 thereof.

FIGS. 3 and 5 show the locking shaft 51 and cam 72 in their home or locking position, with the upper end of the shaft 51 bearing against the high portion 104 of the cam 72. In order to cause the locking shaft 51 to be moved to an unlocked position, thereby releasing the base slide assembly 36, the key shaft 76, on which the cam 72 is mounted, is rotated through 180° in a clockwise direction (with reference to FIGS. 5 and 6) by means of the key 78 until the shoulder 102 engages the upper end of the locking shaft 51. Upon completion of this unlocking operation via the key 78, the locking shaft 51 is in engagement with the low portion 106 of the cam 72 (FIG. 6), the shaft 51 being moved upwardly during the rotation of the cam 72 by means of the spring 68 (FIG. 3). It should be understood that the cam 72 is able to undergo this 180° of rotation because the lug 94 of the latch 82 is held out of the path of rotation of the shoulder 102 by virtue of the lug 94 being in engagement with the stop 96. After the shoulder 102 is moved past the lug 94 during the above-mentioned rotation of the cam 72, the stud 98 on the cam 72 moves into engagement with the extension 100 of the latch 82, and continued rotation of the cam 72 causes the stud 98 to pivot the latch 82 in a clockwise direction (with reference to FIGS. 5 and 6) so as to actuate or trip the latch 82 by moving the lug 94 out of engagement with the stop 96; tripping of the latch 82 takes place after approximately 135° of rotation of the cam 72 from its home position shown in FIG. 5. Upon the latch 82 being tripped, it is moved from right to left (with reference to FIGS. 5 and 6) under the action of the spring 88 so as to bring the lug 94 into contact with the periphery of the cam 72. It will be appreciated that following the above-described rotation through 180°, a locking operation via the key 78 can take place provided that the slide assembly 36 is in its fully inserted position shown in FIG. 3. During such locking operation, the cam 72 is returned to its home position by means of the key 78, the cam 72 rotating back through 180° in a counterclockwise direction (as viewed in FIG. 6) with the lug 94 riding over the surface of the cam 72. However, once the latch 82 has been tripped, then until the latch 82 is reset into a primed state (shown in FIG. 5) the cam 72 cannot be again rotated through 180° in a clockwise direction since after approximately 90° of such rotation, the shoulder 102 will engage with the lug 94 thereby stopping further rotation of the cam 72. The locking shaft 51 at this time will still be in engagement with the high portion 104 of the cam 72 so that the slide assembly will remain locked in its fully inserted position. As will be made clear hereinafter, the cam 72, the latch 82 and the locking shaft 51 form a tamper indicating mechanism which will indicate whether an unauthorized unlocking of the locking mechanism 80 has taken place.

It should be understood that a locking operation of the key 78 (FIG. 3) can take place only when the slide assembly 36 is in its fully inserted position (as shown in FIG. 3), i.e., when the aperture 52 (FIG. 1) in the slide 38 is aligned with the locking shaft 51; in this connection it should be noted that a locking operation of the key 78 is prevented when the slide assembly 36 is in its fully retracted position (FIG. 4) by virtue of the lower end of the locking shaft 51 coming into engagement with the end slide 40 after approximately 45° of rotation of the cam 72 back from its "180° from home position" position shown in FIG. 6. Also it should be noted that the key 78 can be withdrawn from the locking mechanism only when the cam 72 is in its home position shown in FIG. 5 or its 180° from its home position as shown in FIG. 6.

Figure 7:
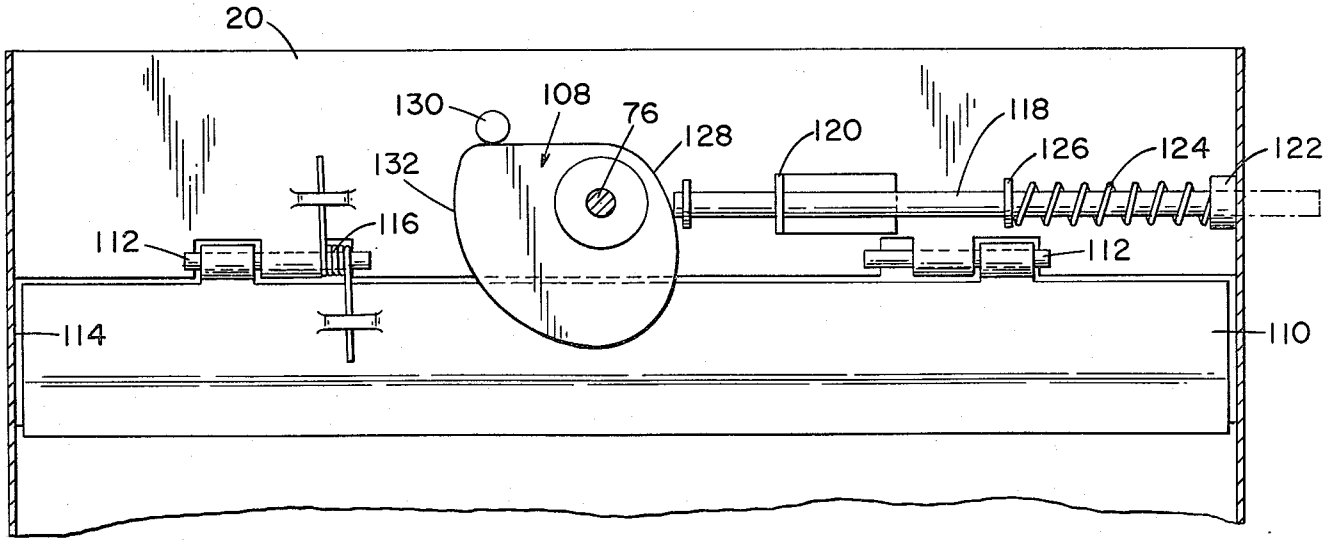
FIG.7 is a part sectional view taken along the line 7—7 of FIG. 2 showing a cam assembly for controlling the operation of a shutter provided in the rear wall of the cassette.

Referring now particularly to FIGS. 3 and 7, a second cam 108 is mounted on the key shaft 76. One of the functions of the cam 108 is to control operation of a shutter 110, which when in an open position as shown in phantom outline in FIG. 3, permits notes rejected by the cash dispensing machine to be deposited back into the cassette 9. The shutter 110 is mounted by means of hinges 112 in an aperture 114 formed in the rear wall 20 of the housing 10, and when the cam 108 is in its home position as shown in FIG. 7 (which position corresponds to the home position of the cam 72), the shutter 110 serves to close the aperture 114. The shutter 110 is urged to rotate from its closed position towards its open position by means of a torsion spring 116, but such inward rotation of the shutter 110 is prevented by the cam 108 when the latter is in its home position as shown in FIG. 7.

One end of a horizontally extending shaft 118 bears against the periphery of the cam 108, the shaft 118 being slidably mounted in a bracket 120 and a bushing 122 secured to the rear wall 20 of the housing 10. The shaft 118 is urged against the periphery of the cam 108 by means of a compression spring 124 one end of which engages a collar 126 secured to the shaft 118 and the other end of which engages a bushing 122. With the cam 108 in its home position, the shaft 118 bears against a low portion 128 of the cam 108, and the cam 108 engages a stud 130 mounted on the rear wall 20, the stud 130 limiting rotational movement of the cam 108 in a clockwise direction (with reference to FIG. 7). With the shaft 118 bearing against the low portion 128 of the cam 108, that end of the shaft 118 remote from the cam 108 is in a retracted position in which it does not project beyond the outside surface of the housing 10. When the key shaft 76 is rotated through 180° from its home position as previously described in relation to the cam 72 (i.e., during an unlocking operation via the key 78), the cam 108 moves above the upper edge of the shutter 110, thereby permitting the shutter 110 to rotate inwardly through 90° under the action of the spring 116 into its open position as shown in phantom outline in FIG. 3. Also, such rotation of the key shaft 76 causes a high portion 132 of the cam 108 to come into engagement with the shaft 118 so as to urge the shaft 118 from left to right (with reference to FIG. 7) and thereby cause the shaft 118 to project beyond the outside surface of the housing 10. As will be explained later, the shaft 118 provides a means for locking the cassette 9 in position in the cash dispensing machine. It should be understood that activation of the shaft 118 so as to cause it to project beyond the outside surface of the housing 10 takes place during the first 90° of rotation of the key shaft 76 from its home position, while the opening of the shutter 110 takes place during the final 45° of this rotation.

The front wall 19 of the housing 10 (FIG. 1) is provided with a carrying handle 134 to facilitate transportation of the cassette 9.

The operation of the cassette 9 (FIG. 1) will now be described in detail. The loading of the cassette 9 with the currency notes 17 normally takes place in a secure area, i.e., in a bank, remote from the building in which the cash dispensing machine is situated. In order to load the cassette 9 with currency notes, the cover 24 is unlocked by means of the key 28 (FIG. 3) and is removed from the housing 10, the slide assembly 36 being in a fully inserted position and being locked in position by means of the locking shaft 51 as shown in FIG. 3. The currency notes 17 are stacked in the two compartments 11 and 12, and the packer plates 34 (FIG. 2) are placed on top of the stacks. Next, the latch 82 (FIG. 5) is primed by moving it against the action of the spring 88 and bringing the lug 94 into engagement with the stop 96 as is best shown in FIG. 2. The cover 24 is then replaced and locked in position by means of the key 28, which key is normally retained at the bank. With both locking mechanisms 26 and 80 in a locked condition, the cassette 9 is in a condition for transportation to the cash dispensing machine.

Following delivery to the cash dispensing machine, the cassette 9 is inserted into the machine and the locking mechanism 80 (FIG. 3) is unlocked by rotating the key 78 through 180°. As has been previously explained, this rotation of the key 78 brings about a corresponding rotation of the key shaft 76 and of the cams 72 and 108 mounted on this shaft. During the first 90° of this rotation of the key shaft 76, the shaft 118 (FIG. 7) is moved by the cam 108 to an activated position in which it projects outside the housing 10 (as shown in FIG. 1), the shaft 118 engaging a recess in the wall (not shown) of the compartment of the cash dispensing machine in which the cassette 9 is inserted, thereby locking the cassette 9 in position in the machine. After 135° of this rotation of the key shaft 76, the latch 82 is tripped (FIG. 6) by virtue of the stud 98 on the cam 72 engaging with the extension 100 of the latch 82. During the final 45° of this rotation of the key shaft 76, the shutter 110 (FIGS. 2 and 3) is opened, and the locking shaft 51 rises out of engagement with the aperture 52 in the slide 38. With the locking shaft 51 out of engagement with the slide 38, the slide 38 can be withdrawn from the cassette 9 and pivoted into its upright position shown in FIGS. 1 and 4. Thus, with both the shutter 110 open and the slide 38 withdrawn, the cassette 9 is in operative communication with the cash dispensing machine, thereby permitting notes to be picked from the cassette 9 by conventional picking means provided in the cash dispensing machine and permitting notes rejected by the machine to be deposited in the cassette 9 via the opening otherwise covered by the shutter 110. It will be appreciated that the shutter 110 is not opened and the slide 38 is not unlocked until after the cassette 9 is locked in the cash dispensing machine by means of the shaft 118, this being an additional security feature.

After the cassette 9 is exhausted of currency notes, or after the quantity of notes in the cassette falls to a predetermined level, the slide assembly 36 is pushed back into its fully inserted position in the cassette 9 and the key 78 is rotated through 180° to its home position, thereby withdrawing the shaft 118 from engagement with the cash dispensing machine, relocking the base slide assembly 36 in its fully-inserted position by means of the locking shaft 51, and closing the shutter 110. The cassette 9 may now be withdrawn from the cash dispensing machine and be replaced by another loaded cassette 9.

It should be understood that if the locking mechanism 80 (FIG. 3) were unlocked and then relocked during transportation of the loaded cassette 9 from the bank to the cash dispensing machine, then the latch 82 would be tripped prior to insertion of the cassette 9 in the machine. This would mean that with the cassette 9 inserted in the cash dispensing machine it would be found impossible to rotate the key 78 through 180°, since after 90° of rotation the shoulder 102 of the cam 72 (FIGS. 5 and 6) would come into engagement with the lug 94. As a result of rotation of the cam 72 being stopped after 90°, the locking shaft 51 would still be in engagement with the high portion 104 of the cam 72, so that withdrawal of the slide 38 would be prevented by virtue of the locking shaft 51 still being in engagement in the aperture 52. Thus, the cassette 9 would remain inoperative until such time as it would be returned to the bank for the cover 24 to be unlocked and removed and for the latch 82 to be reset to its primed state. It will be appreciated, therefore, that the latch 82, the cam 72 and the locking shaft 51 together constitute an effective tamper indicating mechanism which will indicate, for example, whether or not an unauthorized unlocking of the locking mechanism 80 has occurred during transportation of the cassette 9 to the cash dispensing machine.

It will be appreciated that the cassette 9 described above is entirely mechanical in construction and therefore requires no electrical power supply. Also, the cassette 9 is of simple construction because the key 78 and the key shaft 76 serve to control a plurality of operations: namely, locking and unlocking of the base slide assembly 36, operating the shutter 110, operating the shaft 118 for locking the cassette in the cash dispensing machine, and tripping of the latch 82.

What is claimed is:

1. Apparatus for storing items to be dispensed comprising:

a receptacle for storing said items;

locking mechanism for locking said receptacle in a closed condition to prevent access to said items and also for unlocking said receptacle so as to permit access to said items; and means for indicating tampering being operatively coupled with said locking mechanism for giving an indication that a cycle including an unlocking of said receptacle followed by a locking of said receptacle has occurred after a said cycle has in fact occurred;

said tampering indicating means including a latch mechanism which is settable to a first state prior to an unlocking operation of said receptacle, said latch mechanism being operatively coupled to said locking mechanism so as to be set to a second state during a said cycle including said unlocking and locking operation of said receptacle, said second state of said latch mechanism being an indication that said cycle has taken place;

said receptacle having a removeable and lockable cover which is separate from said locking mechanism, said cover providing access to said latch mechanism to enable said latch mechanism to be set to said first state and said cover also facilitating the loading of said receptacle with said items to be dispensed.

2. Apparatus as claimed in claim 1 in which said tampering indicating means further includes a rotatable mechanism, and said locking mechanism includes a key for rotating said rotatable mechanism, whereby said rotatable mechanism is arranged to undergo a predetermined cycle of rotation during said cycle including said unlocking and locking of said receptacle, and whereby said rotatable mechanism becomes operatively coupled to said latch mechanism when said latch mechanism is in said second state to prevent said rotatable mechanism from rotating through its complete said predetermined cycle of rotation following an actuation of said latch mechanism until such time as said latch mechanism is reset to said first state.

3. Apparatus as claimed in claim 2 in which said rotatable mechanism includes a member which engages said latch mechanism to set said latch mechanism in said second state when said rotatable mechanism is rotated through said predetermined cycle of rotation.

4. Apparatus as claimed in claim 3 in which said receptacle has an opening therein and also has a slide mechanism located therein which is moveable between closed and open positions with respect to said opening, whereby access to said items is permitted and denied, respectively, when said slide mechanism is in said open and closed positions, respectively, and whereby a locking operation of said locking mechanism locks said slide mechanism in said closed position and an unlocking operation of said locking mechanism enables said slide mechanism to be moved to said open position.

5. Apparatus as claimed in claim 4 in which said rotatable mechanism includes a cam member and in which said locking mechanism includes a locking member which is operatively coupled to said cam member to be moved into a first position in which said locking member engages said slide mechanism to lock said slide mechanism in said closed position and a second position in which said locking member is disengaged from said slide mechanism so as to enable said slide mechanism to be moved to said open position.

6. Apparatus as claimed in claim 5 in which said receptacle has a wall having an opening therein and further includes a shutter means for closing and opening said opening in said wall; said shutter means being operatively connected to said rotatable mechanism to move said shutter means between first and second positions for respectively closing and opening said opening in said wall.

7. Apparatus for storing items to be dispensed comprising:

a receptacle for storing said items;

locking mechanism for locking said receptacle in a closed condition to prevent access to said items and and also for unlocking said receptacle so as to permit access to said items; and means for indicating tampering being operatively coupled with said locking mechanism for giving an indication that a cycle including an unlocking of said receptacle followed by a locking of said receptacle has occurred after a said cycle has in fact occurred;

said tampering indicating means including a latch mechanism which is settable to a first state prior to an unlocking operation of said receptacle, said latch mechanism being operatively coupled to said locking mechanism so as to be set to a second state during a said cycle including said unlocking and locking operation of said receptacle, said second state of said latch mechanism being an indication that said cycle has taken place;

said receptacle having a removeable and lockable cover which is separate from said locking mechanism, said cover providing access to said latch mechanism to enable said latch mechanism to be set to said first state and said cover also facilitating the loading of said receptacle with said items to be dispensed;

said tampering indicating means further including a rotatable mechanism, and said locking mechanism including a key for rotating said rotatable mechanism, whereby said rotatable mechanism is arranged to undergo a predetermined cycle of rotation during said cycle including said unlocking and locking of said receptacle, and whereby said rotatable mechanism becomes operatively coupled to said latch mechanism when said latch mechanism is in said second state to prevent said rotatable mechanism from rotating through its complete said predetermined cycle of rotation following an actuation of said latch mechanism until such time as said latch mechanism is reset to said first state;

said rotatable mechanism including a member which engages said latch mechanism to set said latch mechanism in said second state when said rotatable mechanism is rotated through said predetermined cycle of rotation;

said receptacle having an opening therein and also having a slide mechanism located therein which is moveable between closed and open positions with respect to said opening, whereby access to said items is permitted and denied, respectively, when said slide mechanism is in said open and closed positions, respectively, and whereby a locking operation of said locking mechanism locks said slide mechanism in said closed position and an unlocking operation of said locking mechanism enables said slide mechanism to be moved to said open position;

said rotatable mechanism including a cam member and said locking mechanism including a locking member which is operatively coupled to said cam member to be moved into a first position in which said locking member engages said slide mechanism to lock said slide mechanism in said closed position and a second position in which said locking member is disengaged from said slide mechanism so as to enable said slide mechanism to be moved to said open position;

said receptacle having a wall having an opening therein and further including a shutter means for closing and opening said opening in said wall; said shutter means being operatively connected to said rotatable mechanism to move said shutter means between first and second positions for respectively closing and opening said opening in said wall; and said rotatable mechanism including a shaft and a second cam member which is operatively coupled to said shutter means and said shaft; said cam member also being operatively coupled to said shaft, and said shaft being operatively coupled to said key to be rotated thereby.

8. Apparatus as claimed in claim 7 in which said receptacle has a second locking member which is moveable between active and inactive positions, said second locking member when in said active position being capable of locking said apparatus in a compartment of a cash dispensing machine, said second locking member being operatively coupled to said second cam member whereby said second locking member is moved to said active position during an unlocking operation of said locking mechanism prior to said slide mechanism being unlocked.

* * * * *